United States Patent [19]

Hauser

[11] Patent Number: 4,723,779

[45] Date of Patent: Feb. 9, 1988

[54] BASE WITH TAPERED SIDES

[76] Inventor: Michael A. Hauser, 15350 Venetian Way, Morgan Hill, Calif. 95037

[21] Appl. No.: 365,195

[22] Filed: Apr. 5, 1982

[51] Int. Cl.[4] ..... A63B 69/40

[52] U.S. Cl. ..... 273/25

[58] Field of Search ..... 273/25; D21/199

[56] References Cited

U.S. PATENT DOCUMENTS

| | | | |
|---|---|---|---|
| 2,122,266 | 6/1938 | Seys | 273/25 |
| 2,220,142 | 11/1940 | Broxton | 273/25 |
| 2,440,042 | 4/1948 | Freidman | 273/25 |
| 2,624,580 | 1/1953 | Corbett | 273/25 |
| 2,695,784 | 11/1954 | Orsatti et al. | 273/25 |
| 3,126,203 | 3/1964 | Bourret | 273/25 |
| 3,204,958 | 9/1965 | Valesquez | 273/25 |
| 3,466,039 | 9/1969 | Golomb | 273/25 |
| 3,508,747 | 4/1970 | Orsatti | 273/25 |
| 3,572,705 | 3/1971 | Wyble | 273/25 |
| 3,837,646 | 9/1974 | Goeders | 273/25 |
| 3,862,756 | 1/1975 | Selliken | 273/25 |

*Primary Examiner*—Richard C. Pinkham
*Assistant Examiner*—T. Brown
*Attorney, Agent, or Firm*—Thomas Schneck

[57] ABSTRACT

A lightweight baseball base having gently inclined edges and an elastomeric filler material. The top of the base has a lateral dimension of between 50% to 65% of the total base lateral dimension, with the remainder equally divided between opposed inclined edges. The elastomeric filler is a shaped foam pad with a non-porous cover. The cover is fastened to a bottom support plate which has a tubular sleeve extending therefrom for anchoring the base.

4 Claims, 6 Drawing Figures

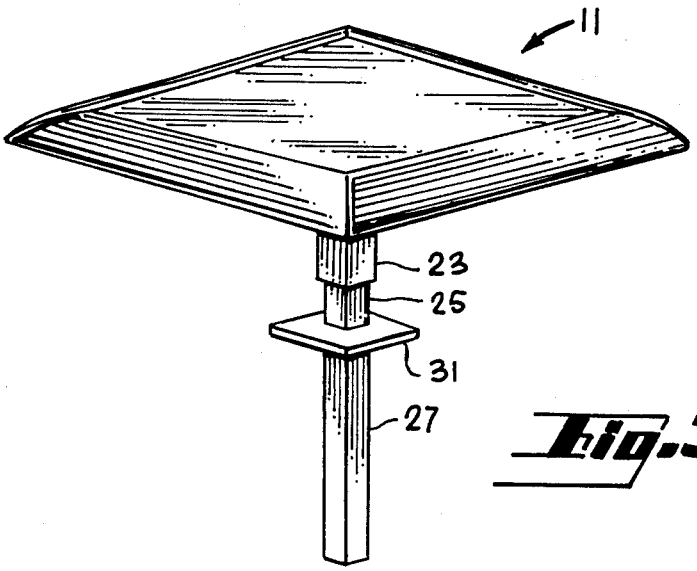
Fig. 3
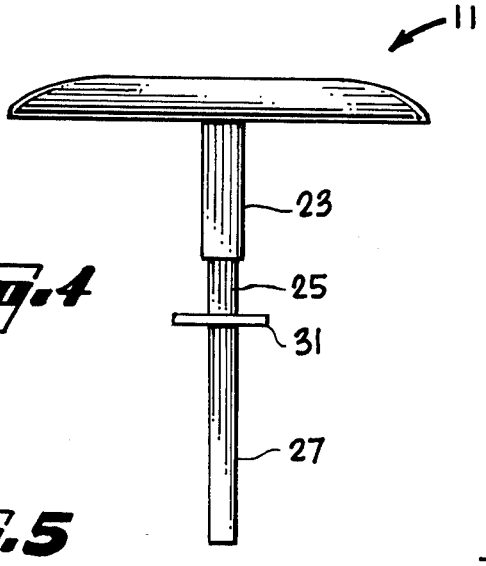
Fig. 4
Fig. 5
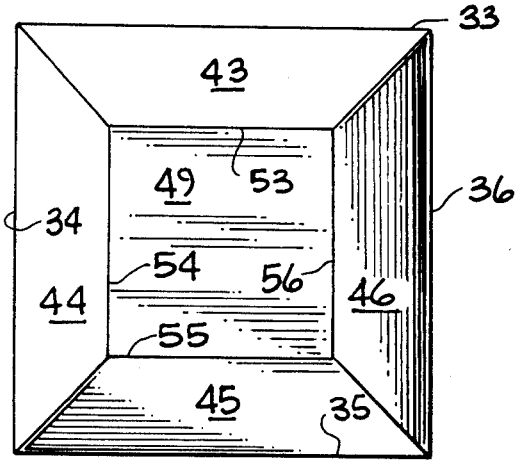
Fig. 6
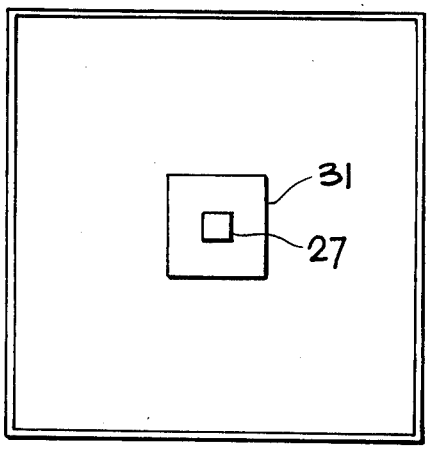

BASE WITH TAPERED SIDES

DESCRIPTION

1. Technical Field

The invention relates to bases used in baseball, particularly youth baseball.

2. Background Art

The prior art has recognized the common risk of tripping over a baseball base while running the base paths. For example, U.S. Pat. Nos. 2,220,142 and 2,624,580 have tapered sides, rather than vertically straight edge walls. Use of tapered side walls or edges eliminates some of the risk in tripping over a base or sliding into a vertical side wall. The limit of the extent of taper provided to a base is usually set by visibility criteria. If a base is made too thin, or its taper too extensive, the base will not be easily visible.

Quite apart from the problem of injury due to encounters with side walls or edges is the problem of mass. Prior art bases typically weigh 40 pounds, when urethane or fiber filling is used. Such massive bases can be injurious in a slide, even without edgewall contact, due to high impact forces.

An object of the invention was to device a baseball base with greater player safety considerations, especially for youth baseball.

DISCLOSURE OF INVENTION

The present invention is particularly intended for youth baseball and provides drastically tapered base side walls or edges in order to provide enhanced safety for running base paths. The extent of side wall taper is such that only approximately fifty to sixty-five percent of a base lateral dimension forms the mesa at the top of the base with approximately the remainder of the lateral base dimension equally divided between opposed sides tapering downwardly toward the ground. The vertical side wall dimension is kept to less than five-eights of an inch and may be as low as zero. Besides radical taper, the present invention provides a light-weight elastomeric filler so that the total base weight is approximately five pounds, most of which is due to metal anchor members, thereby lowering impact forces on collision with a base.

The base construction is such that it is very difficult to suffer an injury due to obstruction of the base path by the base, either due to running and tripping or sliding into the base.

BRIEF DESCRIPTION OF DRAWINGS

FIG. 3 is a top perspective view of the base of FIG. 1.

FIG. 4 is a side elevational view of the base of FIG. 1.

FIG. 5 is a top view of the base of FIG. 1.

FIG. 6 is a bottom view of the base of FIG. 1.

BEST MODE FOR CARRYING OUT THE INVENTION

Figure 1:
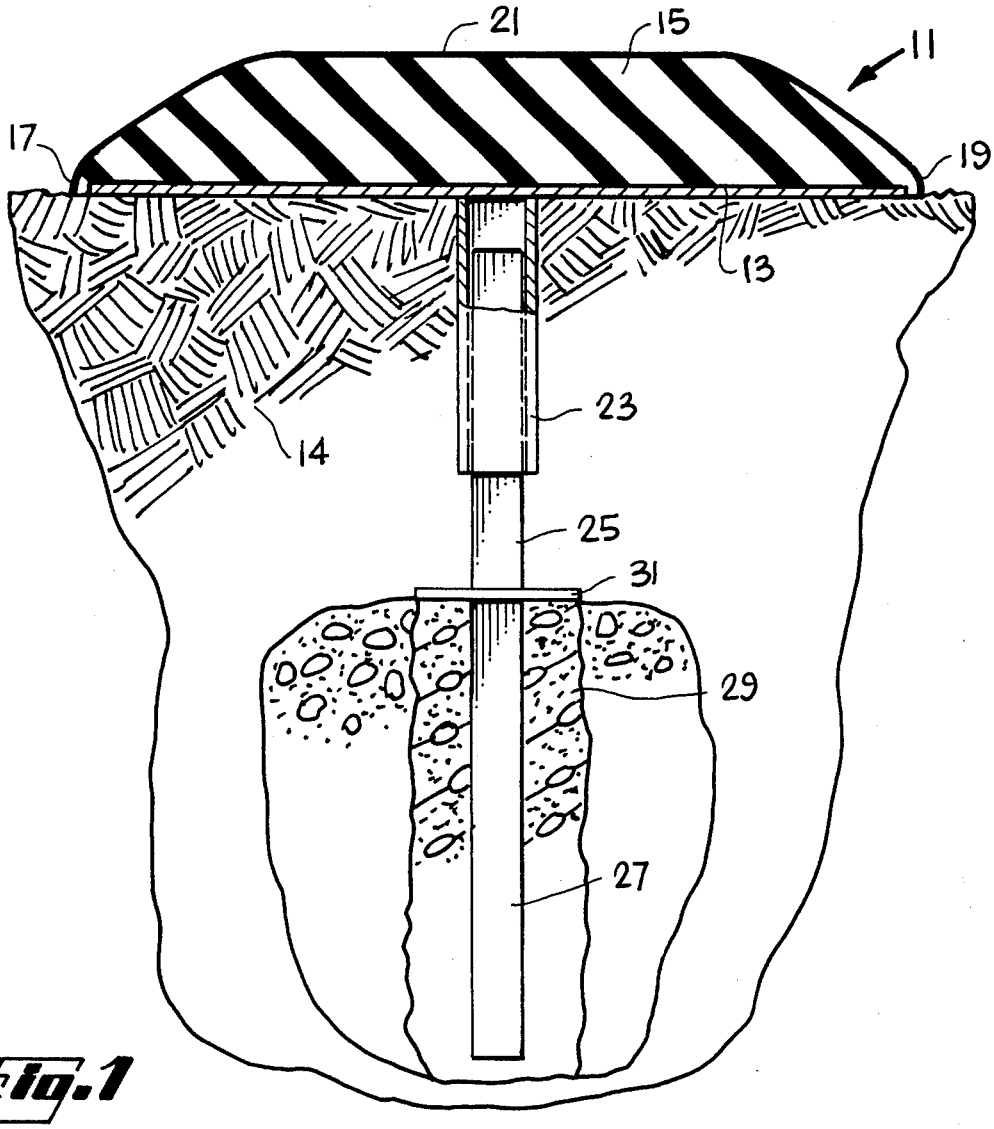
FIG. 1 is a side sectional view of the base of the present invention.

With reference to FIG. 1, base 11 is seen to have a metal support plate 13 which is square and slightly smaller than the overall width of the base at its greatest extent. Plate 13 has major upper and lower opposed surfaces, with the lower opposed surface adapted to rest on the ground 14. The support plate is typically made of aluminum, one-eighth inch thick, slightly under 14 or 15 inches in a side. To the upper major surface of support plate 13 is bonded a shaped pad 15 which weighs only a few ounces. Unlike the prior art, the pad is made of light weight elastomeric material, such a foam rubber. The cross-sectional shape of the pad is similar to that shown in FIG. 1. Bonding of pad 15 to support plate 13 is by means of an adhesive, such as epoxy or glue. The edges 17 and 19 of the foam pad slightly overlap the edges of support plate 13 to keep the metal edges from being exposed. At base edges 17 and 19, the base has its only vertical edge dimension which is always kept less than five-eighths of an inch and preferably much less. Since the support plate is one-eighth of an inch thick, it is typical that the vertical dimension will be slightly greater than one-eighth inch. It is important to minimize the vertical edge dimension of the base.

The pad 15 is covered with a non-porous cover in order to keep moisture from entering the pad material and adding weight to the base. Fabric material such as tough vinyl or rubber is preferred. The thickness and toughness of the cover must be such that baseball shoes will not cut the cover. To the bottom of support plate 13, at the approximate center, is a metal rectangular tube 23, for the purpose of securing the base to a base anchor. Tube 23 is typically six inches long, formed of square tubing, with an inside dimension of one inch on a side, welded to plate 13.

The base anchor assembly consists of a heavy solid pipe of square cross section, slightly less than one inch on a side, over which pipe 23 will snugly fit. A bottom section 27 of the anchor assembly is embedded in concrete 29 or similar material. A shoulder 31 is used to limit penetration of the bottom section 27 into concrete 29 during the manufacture of the base anchor.

Figure 2:
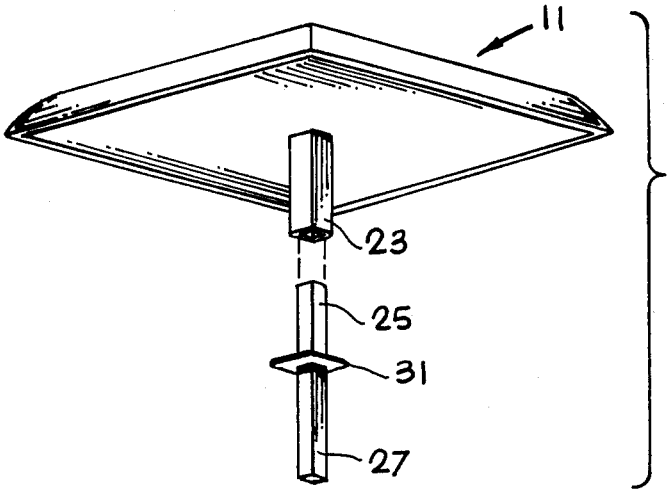
FIG. 2 is a bottom perspective view of the base of FIG. 1.

FIGS. 2–4 illustrate the manner of cooperation of the base with the anchor. The tubular member 23 fits over the pipe section holding base 11 firmly in place. The total length of the top section 25 and the bottom section 27 of the anchor assembly is fourteen inches, with approximately eight inches below shoulder 31. The bottom section 27 is preferably made of steel, with the entire length including sections 25 and 27 of the same cross-sectional dimensions, preferably a single lengthwise member to which shoulder 31 is attached, by welding. Tube 23 is not intended to contact shoulder 31. Rather, the base anchor must be deep enough so that the end of tube 23 rests approximately an inch away from shoulder 31 when the base is properly in position.

With reference to FIG. 5, the overall lateral dimensions of the base may be viewed. The edges 33, 34, 35 and 36 form a square. Side walls 43, 44, 45 and 46 taper upwardly in a gently curving shape which is almost straight, ending in a square mesa 49 which forms the top of the base. The taper is at an angle slightly less than 45 degrees. The mesa 49 has edges 53, 54, 55 and 56. The edges are of equal dimensions, with edge 53 being between fifty percent and sixty-five percent of the length of the lower edge 33. Edge 53 is preferably fifty-seven percent of the length of edge 33. The standard base has an edge dimension of fifteen inches. This would correspond to the length of edge 33, with the dimension of edge 53 being eight and a half inches. For a base used in youth baseball, the length of edge 33 would be fourteen inches while at the top of the base, the upper edge 53 would have a dimension of seven and a half inches.

With respect to FIG. 6, the bottom view of the base reveals that the lower anchoring pipe 27 and shoulder 31 are mounted directly at the center of the bottom of the base.

One of the advantages of the base construction of the present invention is that no straps are used. Most, if not all, bases of the prior art employ internal structural members such as belts or ribs for attachment to an anchor assembly. The present invention completely dispenses with such members for reasons of safety, i.e., belts and ribs can catch a cleat, even though buried within the base. The base of the present invention is deemed to be safer from the standpoint of having almost no vertical edge walls, from the standpoint of being less massive and from the standpoint of having an elastomeric quality.

I claim:

1. A square baseball base comprising, a square rigid support plate, having upper and lower opposed major surfaces, a shaped, elastomeric pad mounted on said upper major surface, said pad having a non-porous cover, the cross-sectional shape of the pad and cover being square and having approximately the center 50% to 65% of a lateral base dimension at a maximum elevation flat and parallel with the ground and having the remainder of the lateral base dimension on both opposed sides of said center half tapering downwardly, equally, to a vertical dimension relative to the ground of less than five-eights of an inch, a hollow ground implantation sleeve extending perpendicularly from the center of the lower major surface of the support plate.

2. A square baseball base having a thin rectangular support plate having opposed upper and lower major surfaces, with a ground implantation sleeve extending from the lower major surface, wherein the support plate rests on the ground and the implantation sleeve anchors the plate in a fixed location, the improvement comprising, a shaped elastomeric pad with a non-porous cover, both the cover and the pad bonded to the upper major surface of the support plate, the cross-sectional shape of the pad and cover being square and having approximately the center 50% to 65% of a lateral base dimension at a maximum elevation flat and parallel with the ground and having the remainder of the lateral base dimension on both opposed sides of said center half tapering downwardly, equally, to a vertical dimension relative to the ground of less than five-eights of an inch.

3. The base of claim 1 or 2 wherein said vertical dimension is less than or equal to one-half inch.

4. The base of claim 1 or 2 wherein said elastomeric pad is made of foam rubber.

* * * * *